US012433320B2

(12) United States Patent
Zappoli

(10) Patent No.: US 12,433,320 B2
(45) **Date of Patent: *Oct. 7, 2025**

(54) METHOD AND APPARATUS FOR MANUFACTURING A CRIMPED WEB

(71) Applicant: Philip Morris Products S.A., Neuchatel (CH)

(72) Inventor: Stefano Zappoli, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/345,522

(22) Filed: Jun. 30, 2023

(65) Prior Publication Data

US 2023/0337715 A1 Oct. 26, 2023

Related U.S. Application Data

(62) Division of application No. 15/521,640, filed as application No. PCT/EP2015/075418 on Nov. 2, 2015, now Pat. No. 11,730,185.

(30) Foreign Application Priority Data

Nov. 3, 2014 (EP) ..... 14191555

(51) Int. Cl.
*A24B 13/00* (2006.01)
*A24B 15/10* (2006.01)
*A24D 3/02* (2006.01)

(52) U.S. Cl.
CPC ..... *A24B 13/00* (2013.01); *A24B 15/10* (2013.01); *A24D 3/0204* (2013.01)

(58) Field of Classification Search
None
See application file for complete search history.

(56) References Cited

U.S. PATENT DOCUMENTS 2,164,702 A * 7/1939 Davidson ..... A24D 3/0245 156/203
3,224,453 A 12/1965 Mahoney et al.
(Continued)

FOREIGN PATENT DOCUMENTS

EP 2 666 624 A1 11/2013
EP 3 041 375 A2 7/2016
(Continued)

OTHER PUBLICATIONS

Notice of Allowance issued Aug. 19, 2022 in Korean Patent Application No. 2017-7010495 (with English translation), 3 pages.
(Continued)

*Primary Examiner* — Phu H Nguyen
(74) *Attorney, Agent, or Firm* — Oblon, McClelland, Maier &Neustadt, L.L.P.

(57) ABSTRACT

An apparatus for manufacturing a crimped web for an aerosol-generating article is provided, the apparatus including: a set of crimping rollers including a first roller and a second roller, each of which is corrugated across at least a portion of a width thereof, the first and the second rollers being arranged such that corrugations of the first roller substantially interleave with corrugations of the second roller, pitch values of the corrugations of one or both of the first and the second rollers varying across the width of the rollers, and the pitch values of substantially all of the corrugations of the first and the second rollers varying from about 0.5 mm to about 1.7 mm. A crimped sheet, and a method of manufacturing an aerosol-generating article component, are also provided.

8 Claims, 10 Drawing Sheets

(56) References Cited

U.S. PATENT DOCUMENTS

| | | | | |
|---|---|---|---|---|
| 4,269,055 | A | 5/1981 | Sivachenko et al. | |
| 2007/0169786 | A1* | 7/2007 | Li | A24D 1/02 131/365 |
| 2014/0364290 | A1 | 12/2014 | Ferrazzin et al. | |
| 2014/0364291 | A1 | 12/2014 | Ferrazzin et al. | |

FOREIGN PATENT DOCUMENTS

| | | | |
|---|---|---|---|
| JP | 34-5206 | B | 6/1959 |
| JP | 35-2052 | B | 3/1960 |
| JP | 2000-157246 | A | 6/2000 |
| KR | 10-2007-0005648 | A | 1/2007 |
| KR | 10-2014-0107200 | A | 9/2014 |
| KR | 10-2014-0116375 | A | 10/2014 |
| RU | 2 328 953 | C1 | 7/2008 |
| RU | 2 519 976 | C1 | 6/2014 |
| WO | WO 2007/042866 | A1 | 4/2007 |
| WO | WO 2012/164009 | A2 | 12/2012 |
| WO | WO 2013/098353 | A1 | 7/2013 |
| WO | WO 2013/098405 | A2 | 7/2013 |
| WO | WO 2014/125049 | A1 | 8/2014 |
| WO | WO 2015/028644 | A2 | 3/2015 |

OTHER PUBLICATIONS

Combined Russian Office Action and Search Report issued on Apr. 23, 2019 in Patent Application No. 2017119238, 17 pages (with English translation).

International Search Report and Written Opinion issued Jan. 25, 2016 in PCT/EP2015/075418, filed Nov. 2, 2015.

Office Action issued Nov. 18, 2019 in Japanese Patent Application No. 2017-523416, 4 pages (with English translation).

* cited by examiner

METHOD AND APPARATUS FOR MANUFACTURING A CRIMPED WEB

CROSS-REFERENCE TO RELATED APPLICATIONS

This application is a divisional of and claims benefit under 35 U.S.C. § 120 to U.S. patent application Ser. No. 15/521,640, filed Apr. 25, 2017, which is a U.S. National Stage application of PCT/EP2015/075418, filed Nov. 2, 2015, which is based upon and claims the benefit of priority under 35 U.S.C. § 119 from European Patent Application No. 14191555.3, filed Nov. 3, 2014, the entire contents of each of which are incorporated herein by reference.

The present disclosure relates to a method and apparatus for manufacturing a crimped web. In particular, the present invention relates to a method and apparatus for manufacturing a crimped web for an aerosol-generating article.

Conventional cigarettes combust tobacco and generate temperatures that release volatile compounds. Temperatures in the burning tobacco can reach above 800 degrees Celsius and such high temperatures drive off much of the water contained in the smoke evolved from the tobacco. Other aerosol-generating articles in which an aerosol-forming substrate, such as a tobacco containing substrate, is heated rather than combusted are also known in the art. Examples of systems using aerosol-generating articles include systems that heat a tobacco containing substrate between 200 and 400 degrees Celsius to produce an aerosol. Despite the lower temperature of aerosol formation, the aerosol stream generated by such systems may have a higher perceived temperature than conventional cigarette smoke due to a higher moisture content, compared to combustible smoking articles.

Typically, aerosol-generating articles comprise a plurality of elements assembled in the form of a rod. The plurality of elements generally includes an aerosol-forming substrate and an aerosol-cooling element located downstream from the aerosol-forming substrate within the rod. The aerosol-cooling element may alternatively be referred to as a heat exchanger based on its functionality. One or both of the aerosol-cooling element and the aerosol-forming substrate may comprise a plurality of axial channels to provide air-flow in the axial direction. The plurality of axial channels may be defined by a sheet that has been crimped and gathered within the rod to form the channels. In such examples, the crimped sheet is generally formed by crimping a substantially continuous web and cutting a plurality of crimped sheets from the crimped and gathered web.

Methods and apparatuses for manufacturing a crimped web for use in an aerosol-generating article are known in the art. Known methods of manufacturing a crimped web generally involve feeding a substantially continuous web between a pair of interleaved rollers to apply a plurality of parallel, equidistant longitudinally extending crimp corrugations to the continuous web. The crimped web is subsequently gathered to form a continuous rod having a plurality of axial channels. The rod is then wrapped and cut into smaller segments to form an aerosol-forming substrate or aerosol-cooling element for an aerosol-generating article.

However, such known methods can lead to a non-uniform distribution of crimped material in the rod. This can lead to variations in the resistance to draw between different aerosol-generating articles.

It would be desirable to provide a method an apparatus for manufacturing a crimped web for an aerosol-generating article that allows more even distribution of crimped material in an aerosol-generating article in which the crimped web is used.

According to a first aspect of the present invention, there is provided a method of manufacturing a crimped web for an aerosol-generating article, the method comprising the steps of: feeding a substantially continuous web to a set of crimping rollers, the set of rollers comprising a first roller and a second roller, each of which is corrugated across at least a portion of its width, the first and second rollers being arranged such that the corrugations of the first roller substantially interleave with the corrugations of the second roller; and crimping the substantially continuous web to form the crimped web by feeding the substantially continuous web between the first and second rollers in a longitudinal direction of the web such that the corrugations of the first and second rollers apply a plurality of longitudinally extending and substantially parallel crimp corrugations to the substantially continuous web, wherein the pitch values of the corrugations of one or both of the first and second rollers vary across the width of the rollers such that the pitch values of the crimped corrugations vary across the width of the crimped web.

When forming a rod for an aerosol-generating article from a gathered crimped sheet manufactured using a conventional method, in which the crimp corrugations have substantially the same pitch value across the width of the crimped web, it has been found that the crimp corrugations of overlying portions of crimped sheet can have a tendency to align and nest together in clusters, leaving large axial channels in other portions of the rod. This lowers the overall resistance to draw of the aerosol-generating article, since air drawn through the rod can more easily pass along the axial channels. Further, due to the cooling, aerosol droplets form. The droplet size depends on the type of molecules that form the aerosol, the temperature drop, the speed of the aerosol within the channel and the size of the channels. However, the non-uniform distribution of crimped sheet can vary substantially from article to article, leading to substantial variations in resistance to draw and aerosol droplet size. Advantageously, by crimping the continuous web such that the pitch values of the crimped corrugations vary across the width of the crimped web, the crimp corrugations of a crimped sheet formed from the crimped web are less likely to nest against each other when the crimped sheet is gathered to form a rod for use in an aerosol-generating article. Consequently, and advantageously, the distribution of the crimped sheet and the size of the axial channels are more uniform. Further, advantageously the variance in resistance to draw values and aerosol droplet size can be reduced.

As used herein, the term 'aerosol-generating article' refers to an article comprising an aerosol-forming substrate that is capable of releasing volatile compounds that can form an aerosol, for example by heating, combustion or a chemical reaction.

As used herein, the term 'aerosol-forming substrate' is used to describe a substrate capable of releasing volatile compounds, which can form an aerosol. The aerosols generated from aerosol-forming substrates of aerosol-generating articles according to the invention may be visible or invisible and may include vapours (for example, fine particles of substances, which are in a gaseous state, that are ordinarily liquid or solid at room temperature) as well as gases and liquid droplets of condensed vapours.

As used herein, the term 'aerosol-cooling element' is used to describe an element having a large surface area and a predetermined resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol cooling elements.

As used herein, the term 'sheet' denotes a laminar element having a width and length substantially greater than the thickness thereof.

As used herein, the term 'crimped' denotes a sheet or web with a plurality of corrugations.

As used herein, the term 'corrugations' denotes a plurality of substantially parallel ridges formed from alternating peaks and troughs joined by corrugation flanks. This includes, but is not limited to, corrugations having a square wave profile, sinusoidal wave profile, triangular profile, sawtooth profile, or any combination thereof.

As used herein, the term 'crimp corrugations' refers to the corrugations on a crimped sheet or web.

As used herein, the term 'substantially interleave' denotes that the corrugations of the first and second rollers at least partially mesh. This includes arrangements in which the corrugations of one or both of the rollers are symmetrical or asymmetrical. The corrugations of the rollers may be substantially aligned, or at least partially offset. The peak of one or more corrugations of the first or second rollers may interleave with the trough of a single corrugation of the other of the first and second rollers. Preferably, the corrugations of the first and second rollers interleave such that substantially all of the corrugation troughs of one of the first and second rollers each receive a single corrugation peak of the other of the first and second rollers.

As used herein, the term 'longitudinal direction' refers to a direction extending along, or parallel to, the length of a web or sheet.

As used herein, the term 'width' refers to a direction perpendicular to the length of a web or sheet, or in the case of a roller, parallel to the axis of the roller.

As used herein, the term 'pitch value' refers to the lateral distance between the troughs at either side of the peak of a particular corrugation.

As used herein, the terms 'vary' and 'differ' refer to a deviation beyond that of standard manufacturing tolerances and in particular to values that deviate from each other by at least 5 percent.

According to a second aspect of the present invention, there is provided a method of manufacturing an aerosol-generating article component, the method comprising the steps of: manufacturing a crimped web according to the method described above; gathering the crimped web to form a continuous rod; and cutting the continuous rod into a plurality of rod-shaped components, each rod-shaped component having a gathered crimped sheet formed from a cut portion of the crimped web, the crimp corrugations of the crimped sheet defining a plurality of axial channels in the rod-shaped component.

As used herein, the term 'rod' denotes a generally cylindrical element of substantially circular or oval cross-section.

As used herein, the terms 'axial' or 'axially' refer to a direction extending along, or parallel to, the cylindrical axis of a rod.

As used herein, the terms 'gathered' or 'gathering' denote that a web or sheet is convoluted, or otherwise compressed or constricted substantially transversely to the cylindrical axis of the rod.

According to a third aspect of the present invention, there is provided an apparatus for manufacturing a crimped web for an aerosol-generating article, the apparatus comprising: a set of crimping rollers comprising a first roller and a second roller, each of which is corrugated across at least a portion of its width, wherein the first and second rollers are arranged such that the corrugations of the first roller substantially interleave with the corrugations of the second roller, and wherein the pitch values of the corrugations of one or both of the first and second rollers vary across the width of the rollers.

In any of the above embodiments, the pitch values of the majority of corrugations may be substantially the same across the width of the rollers with a small number of corrugations, for example one or two, having a substantially different pitch value or values so that the pitch values of the corrugations vary across the width of the roller or rollers. This may be the case for one or both of the first and second rollers.

In preferred embodiments, at least 10 percent of the corrugations of the first and second rollers have a pitch value that differs from the pitch value of at least one directly adjacent corrugation. In further preferred embodiments, at least 40 percent of the corrugations of the first and second rollers have a pitch value that differs from the pitch value of at least one directly adjacent corrugation. More preferably, at least 70 percent of the corrugations of the first and second rollers have a pitch value that differs from the pitch value of at least one directly adjacent corrugation. Most preferably, all or substantially all of the corrugations of the first and second rollers have a pitch value that differs from the pitch value of at least one directly adjacent corrugation. This further reduces the risk of crimp corrugations on a gathered crimped sheet from matching up and nesting against each other.

In any of the above embodiments, the pitch value of the corrugations of the first and second rollers may be any suitable amount. Preferably, the pitch values of substantially all of the corrugations of the first and second rollers vary from about 0.5 millimetres (mm) to about 1.7 millimetres (mm), preferably from about 0.7 mm to about 1.5 mm, and most preferably from about 0.9 mm to about 1.3 mm. This has been found to provide particularly satisfactory resistance to draw values and uniformity when the rollers are used to form a crimped sheet in an aerosol-generating article.

In any of the above embodiments, to provide pitch values that vary across the width of the rollers, at least some of the corrugations of the first and second rollers may each have an amplitude value that differs from the amplitude value of at least one directly adjacent corrugation. In such embodiments, the amplitude values may be of any suitable amount. For example, the amplitude values of the corrugations of the first and second rollers vary from about 0.1 mm to about 1.5 mm, preferably from about 0.2 mm to about 1 mm, most preferably from about 0.35 mm to about 0.75 mm.

As used herein, the term 'amplitude value' refers to the height of a corrugation from its peak to the deepest point of the deepest directly adjacent trough.

Alternatively, or in addition, to provide pitch values that vary across the width of the rollers at least some corrugations of the first and second rollers may each have a corrugation angle that differs from the corrugation angle of at least one directly adjacent corrugation. In such embodiments, the corrugation angles may be of any suitable value. For example, the corrugation angles of the corrugations of the first and second rollers may vary from about 30 degrees to about 90 degrees, preferably from about 40 degrees to about 80 degrees, more preferably from about 55 degrees to about 75 degrees.

As used herein, the term 'corrugation angle' refers to the angle between the corrugation flanks of a particular corrugation.

One or more of the corrugations may be symmetrical about the radial direction. That is, the angle between each flank of a corrugation and the radial direction, or the "flank angle", may be the same and equal to half the corrugation angle. Alternatively, one or more of the corrugations are asymmetrical about the radial direction. That is, the flank angles of both flanks of a corrugation may be different.

One or more of the troughs between directly adjacent corrugations may be symmetrical about the radial direction. That is, the angle between directly adjacent flanks of directly adjacent corrugations and the radial direction may be the same and equal to half the trough angle. Alternatively, one or more of the troughs between directly adjacent corrugations may be asymmetrical about the radial direction. That is, the flank angles of directly adjacent flanks forming a trough may be different.

Where the corrugation angles vary across the width of the first and second rollers, the amplitude values of the corrugations of the first and second rollers may be substantially the same, or they may also vary across the width of the rollers. Where the amplitude values vary across the width of the first and second rollers, the corrugation angles of the corrugations of the first and second rollers may be substantially the same, or they may also vary across the width of the rollers.

Once crimped, the web can be cut into individual crimped sheets. Preferably, before cutting, the crimped sheet is gathered and wrapped into a continuous rod shape and then cut into individual plugs that contain the crimped and gathered sheet.

According to a fourth aspect of the present invention, there is provided a crimped sheet for use in an aerosol-cooling element for an aerosol-generating article or in an aerosol-forming substrate for an aerosol-generating article, the crimped sheet comprising a plurality of substantially parallel crimp corrugations extending in a longitudinal direction, wherein the pitch values of the crimp corrugations vary across the width of the sheet.

The pitch values of the majority of crimp corrugations may be substantially the same across the width of the sheet, with a small number of crimp corrugations, for example one or two, having a substantially different pitch value or values so that the pitch values of the crimp corrugations vary across the width of the sheet.

In preferred embodiments, at least 10 percent of the crimp corrugations have a pitch value that differs from the pitch value of at least one directly adjacent crimp corrugation, preferably at least 50 percent of the crimp corrugations have a pitch value that differs from the pitch value of at least one directly adjacent crimp corrugation, more preferably at least 70 percent of the crimp corrugations have a pitch value that differs from the pitch value of at least one directly adjacent crimp corrugation and most preferably substantially all of the crimp corrugations have a pitch value that differs from the pitch value of at least one directly adjacent crimp corrugation.

In any of the above embodiments, the pitch value of the crimp corrugations may be any suitable amount. Preferably, the pitch values of the crimp corrugations vary from about 0.5 mm to about 1.7 mm, preferably from about 0.7 mm to about 1.5 mm, most preferably from about 0.9 mm to about 1.3 mm. This has been found to provide particularly satisfactory resistance to draw values and uniformity when the crimped sheet is used in an aerosol-generating article.

In any of the above embodiments, to provide pitch values that vary across the width of the sheet, each of at least some of the crimp corrugations may have an amplitude value that differs from the amplitude value of at least one directly adjacent crimp corrugation. In such embodiments, the amplitude values may be of any suitable amount. For example, the amplitude values of the crimp corrugations may vary from about 0.1 mm to about 1.5 mm, preferably from about 0.2 mm to about 1 mm, most preferably from about 0.35 mm to about 0.75 mm.

Alternatively, or in addition, to provide pitch values that vary across the width of the sheet, each of at least some of the crimp corrugations may have a corrugation angle that differs from the corrugation angle of at least one directly adjacent crimp corrugation. In such embodiments, the corrugation angles may be of any suitable value. For example, the corrugation angles of the crimp corrugations may vary from about 30 degrees to about 90 degrees, preferably from about 40 degrees to about 80 degrees, more preferably from about 55 degrees to about 75 degrees.

Where the corrugation angles vary across the width of sheet, the amplitude values of the crimp corrugations may be substantially the same, or they may also vary across the width of the sheet. Where the amplitude values vary across the width of the sheet, the corrugation angles of the crimp corrugations may be substantially the same, or they may also vary across the width of the sheet.

In any of the above embodiments, the crimped sheet may comprise any suitable material. For example, the crimped sheet may comprise a sheet material selected from the group including a metallic foil, a polymeric sheet, a paper, a homogenised tobacco material, or a combination thereof. In preferred embodiments, the crimped sheet comprises a sheet material selected from the group including polyethylene, polypropylene, polyvinylchloride, polyethylene terephthalate, polylactic acid, cellulose acetate, and aluminium foil. The crimped sheet may be formed from a single layer of material or materials, or from a plurality of layers. The crimped sheet may be laminated.

According to a fifth aspect of the present invention, there is provided an aerosol-cooling element for an aerosol-generating article, the aerosol-cooling element comprising a rod formed from a gathered crimped sheet according to any of the embodiments described above, wherein the crimp corrugations of the crimped sheet define a plurality of axial channels in the rod.

According to a sixth aspect of the present invention, there is provided an aerosol-forming substrate for an aerosol-generating article, the aerosol-forming substrate comprising a rod formed from a gathered crimped sheet according to any of the embodiments described above, wherein the crimp corrugations define a plurality of axial channels in the rod.

According to a seventh aspect of the present invention, there is provided an aerosol-generating article comprising one or both of an aerosol-cooling element according to any of the embodiments described above and an aerosol-forming substrate according to any of the embodiments described above.

The aerosol-cooling element preferably offers a low resistance to the passage of air through the rod. Preferably, the aerosol-cooling element does not substantially affect the resistance to draw of the aerosol-generating article. Thus, it is preferred that there is a low-pressure drop from an upstream end of the aerosol-cooling element to a downstream end of the aerosol-cooling element. To achieve this, it is preferred that the porosity in an axial direction is greater than 50 percent and that the airflow path through the aerosol-cooling element is relatively uninhibited. The axial porosity of the aerosol-cooling element may be defined by a ratio of the cross-sectional area of material forming the aerosol-cooling element and an internal cross-sectional area of the aerosol-generating article at the portion containing the aerosol-cooling element.

The terms "upstream" and "downstream" may be used to describe relative positions of elements or components of the aerosol-generating article. For simplicity, the terms "upstream" and "downstream" as used herein refer to a relative position along the rod of the aerosol-generating article with reference to the direction in which the aerosol is drawn through the rod.

It is desirable that the aerosol-cooling element has a high total surface area. Thus, in preferred embodiments the aerosol-cooling element is formed by a sheet of a thin material that has been crimped and then pleated, gathered, or folded to form the channels. The more folds, crimps or pleats within a given volume of the element, the higher the total surface area of the aerosol-cooling element. In preferred embodiments, the aerosol-cooling element is formed from a gathered crimped sheet according to any of the embodiments described above. In some embodiments, the aerosol-cooling element may be formed from a sheet having a thickness of between about 5 micrometres and about 500 micrometres, for example between about 10 micrometres and about 250 micrometers. In some embodiments, the aerosol-cooling element has a total surface area of between about 300 square millimetres per millimetre of length and about 1000 square millimetres per millimetre of length. In other words, for every millimetre of length in the axial direction the aerosol-cooling element has between about 300 square millimetres and about 1000 square millimetres of surface area. Preferably, the total surface area is about 500 square millimetres per millimetre of length.

The aerosol-cooling element may be formed from a material that has a specific surface area of between about 10 square millimetres per milligram and about 100 square millimetres per milligram. In some embodiments, the specific surface area may be about 35 square millimetres per milligram.

Specific surface area can be determined by taking a material having a known width and thickness. For example, the material may be a PLA material having an average thickness of 50 micrometers with a variation of plus or minus 2 micrometers. Where the material also has a known width, for example, between about 200 mm and about 250 mm, the specific surface area and density can be calculated.

When an aerosol that contains a proportion of water vapour is drawn through the aerosol-cooling element, some of the water vapour may condense on surfaces of the axial channels defined through the aerosol-cooling element. If water condenses, it is preferred that droplets of the condensed water are maintained in droplet form on a surface of the aerosol-cooling element rather than being absorbed into the material forming the aerosol-cooling element. Thus, it is preferred that the material forming the aerosol-cooling element is substantially non-porous or substantially non-absorbent to water.

The aerosol-cooling element may act to cool the temperature of a stream of aerosol drawn through the element by means of thermal transfer. Components of the aerosol will interact with the aerosol-cooling element and loose thermal energy.

The aerosol-cooling element may act to cool the temperature of a stream of aerosol drawn through the element by undergoing a phase transformation that consumes heat energy from the aerosol stream. For example, the material forming the aerosol-cooling element may undergo a phase transformation such as melting or a glass transition that requires the absorption of heat energy. If the element is selected such that it undergoes such an endothermic reaction at the temperature at which the aerosol enters the aerosol-cooling element, then the reaction will consume heat energy from the aerosol stream.

The aerosol-cooling element may act to lower the perceived temperature of a stream of aerosol drawn through the element by causing condensation of components such as water vapour from the aerosol stream. Due to condensation, the aerosol stream may be drier after passing through the aerosol-cooling element. In some embodiments, the water vapour content of an aerosol stream drawn through the aerosol-cooling element may be lowered by between about 20 percent and about 90 percent.

In some embodiments, the temperature of an aerosol stream may be lowered by more than 10 degrees Celsius as it is drawn through an aerosol-cooling element. In some embodiments, the temperature of an aerosol stream may be lowered by more than 15 degrees Celsius or more than 20 degrees Celsius as it is drawn through an aerosol-cooling element.

As noted above, the aerosol-cooling element may be formed from a sheet of suitable material that has been crimped, pleated, gathered or folded into an element that defines a plurality of axial extending channels. A cross-sectional profile of such an aerosol-cooling element may show the channels as being randomly oriented. The aerosol-cooling element may be formed by other means. For example, the aerosol-cooling element may be formed from a bundle of axially extending tubes. The aerosol-cooling element may be formed by extrusion, molding, lamination, injection, or shredding of a suitable material.

The aerosol-cooling element may comprise an outer tube or wrapper that contains or locates the axially extending channels. For example, a flat web material that has been pleated, gathered, or folded, may be wrapped in a wrapper material, for example a plug wrapper, to form the aerosol-cooling element. In some embodiments, the aerosol-cooling element comprises a sheet of crimped material that is gathered into a rod-shape and bound by a wrapper, for example a wrapper of filter paper.

In some embodiments, the aerosol-cooling element is formed in the shape of a rod having a length of between about 7 mm and about 28 mm. For example, an aerosol-cooling element may have a length of about 18 mm. In some embodiments, the aerosol-cooling element may have a substantially circular cross-section and a diameter of about 5 mm to about 10 mm. For example, an aerosol-cooling element may have a diameter of about 7 mm.

In some embodiments, the water content of the aerosol is reduced as it is drawn through the aerosol-cooling element.

An aerosol-generating article may be a heated aerosol-generating article, which is an aerosol-generating article comprising an aerosol-forming substrate that is intended to be heated rather than combusted in order to release volatile compounds that can form an aerosol. A heated aerosol-generating article may comprise an on-board heating means forming part of the aerosol-generating article, or may be configured to interact with an external heater forming part of a separate aerosol-generating device An aerosol-generating article may resemble a combustible smoking article, such as a cigarette. An aerosol-generating article may comprise tobacco. An aerosol-generating article may be disposable. An aerosol-generating article may alternatively be partially-reusable and comprise a replenishable or replaceable aerosol-forming substrate.

As used herein, the term 'homogenised tobacco material' denotes material formed by agglomerating particulate tobacco.

A homogenised tobacco material may be in the form of a sheet. The homogenised tobacco material may have an aerosol-former content of greater than 5 percent on a dry weight basis. The homogenised tobacco material may alternatively have an aerosol former content of between 5 percent and 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghettis, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use. In certain embodiments, at least part of the aerosol-forming substrate is formed from a gathered crimped sheet according to any of the embodiments described above. In such embodiments, the gathered crimped sheet may comprise a sheet of homogenised tobacco material. In certain embodiments, at least part of the aerosol-forming substrate is deposited on the surface of a carrier in the form of a gathered crimped sheet according to any of the embodiments described above.

The elements of the aerosol-generating article are preferably assembled by means of a suitable wrapper, for example a cigarette paper. A cigarette paper may be any suitable material for wrapping components of an aerosol-generating article in the form of a rod. Preferably, the cigarette paper holds and aligns the component elements of the aerosol-generating article when the article is assembled and hold them in position within the rod. Suitable materials are well known in the art.

It may be particularly advantageous for an aerosol-cooling element to be a component part of a heated aerosol-generating article having an aerosol-forming substrate formed from or comprising a homogenised tobacco material having an aerosol former content of greater than 5 percent on a dry weight basis and water. For example the homogenised tobacco material may have an aerosol former content of between 5 percent and 30 percent by weight on a dry weight basis. An aerosol generated from such aerosol-forming substrates may be perceived by a user to have a particularly high temperature and the use of a high surface area, low resistance to draw aerosol-cooling element may reduce the perceived temperature of the aerosol to an acceptable level for the user.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be received in the aerosol-generating device such that the length of the aerosol-forming substrate is substantially parallel to the airflow direction in the aerosol-generating device. The aerosol-cooling element may be substantially elongate.

The aerosol-generating article may have a total length between approximately 30 mm and approximately 100 mm. The aerosol-generating article may have an external diameter between approximately 5 mm and approximately 12 mm.

The aerosol-generating article may comprise a filter or mouthpiece. The filter may be located at the downstream end of the aerosol-generating article. The filter may be a cellulose acetate filter plug. The filter is approximately 7 mm in length in one embodiment, but may have a length of between approximately 5 mm and approximately 10 mm. The aerosol-generating article may comprise a spacer element located downstream of the aerosol-forming substrate.

In one embodiment, the aerosol-generating article has a total length of approximately 45 mm. The aerosol-generating article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm.

Features described in relation to one aspect of the invention may also be applicable to the other aspects of the invention.

The invention will be further described, by way of example only, with reference to the accompanying drawings in which.

Figure 1:
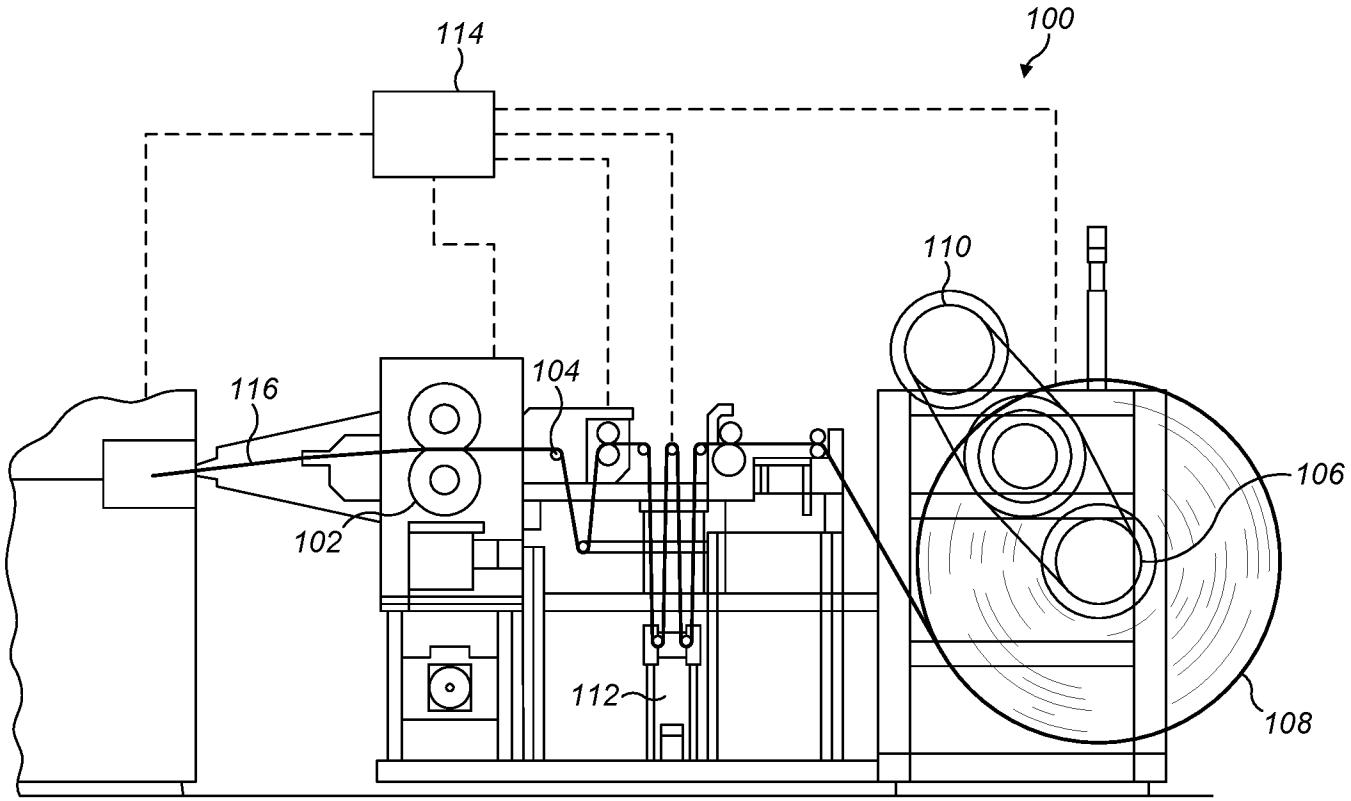
FIG. 1 is a schematic side view of an apparatus for manufacturing a crimped web according to the present invention.

FIG. 1 shows apparatus 100 for manufacturing a crimped web. The apparatus 100 comprises, among other components, a set of crimping rollers 102 including a first roller and a second roller, each of which is corrugated across its width. The set of crimping rollers 102 is arranged such that the corrugations of the first roller substantially interleave with the corrugations of the second roller. The apparatus 100 also comprises a lateral sheet cutting mechanism 104, a bobbin 106 of sheet web material 108, such as a web of polylactide acid, paper, or homogenized tobacco material, a drive and brake mechanism 110, and a tensioning mechanism 112. Control electronics 114 are provided to control the apparatus 100 during operation.

In use, the drive and brake mechanism 110 feeds the web 108 in a longitudinal direction from the bobbin 106 to the set of crimping rollers 102 via the lateral web cutting mechanism 104, which cuts the web to the required width. The tensioning mechanism 112 ensures that the web 108 is fed to the set of crimping rollers 102 at the desired tension. The crimping rollers 102 force the web 108 between the interleaved corrugations of the first and second rollers to apply a plurality of longitudinally extending crimp corrugations to the web 108. In this manner, the web 108 is deformed by the crimping rollers 102 to form a crimped web 116. The crimped web 116 can then be gathered together and used to form an aerosol-cooling element or an aerosol-forming substrate for an aerosol-generating article, as discussed below. For example, the crimped web 116 can be gathered together to form a continuous rod which is subsequently cut into a plurality of rod-shaped components, each having a gathered crimped sheet formed from a cut portion of the crimped web.

Figure 2:
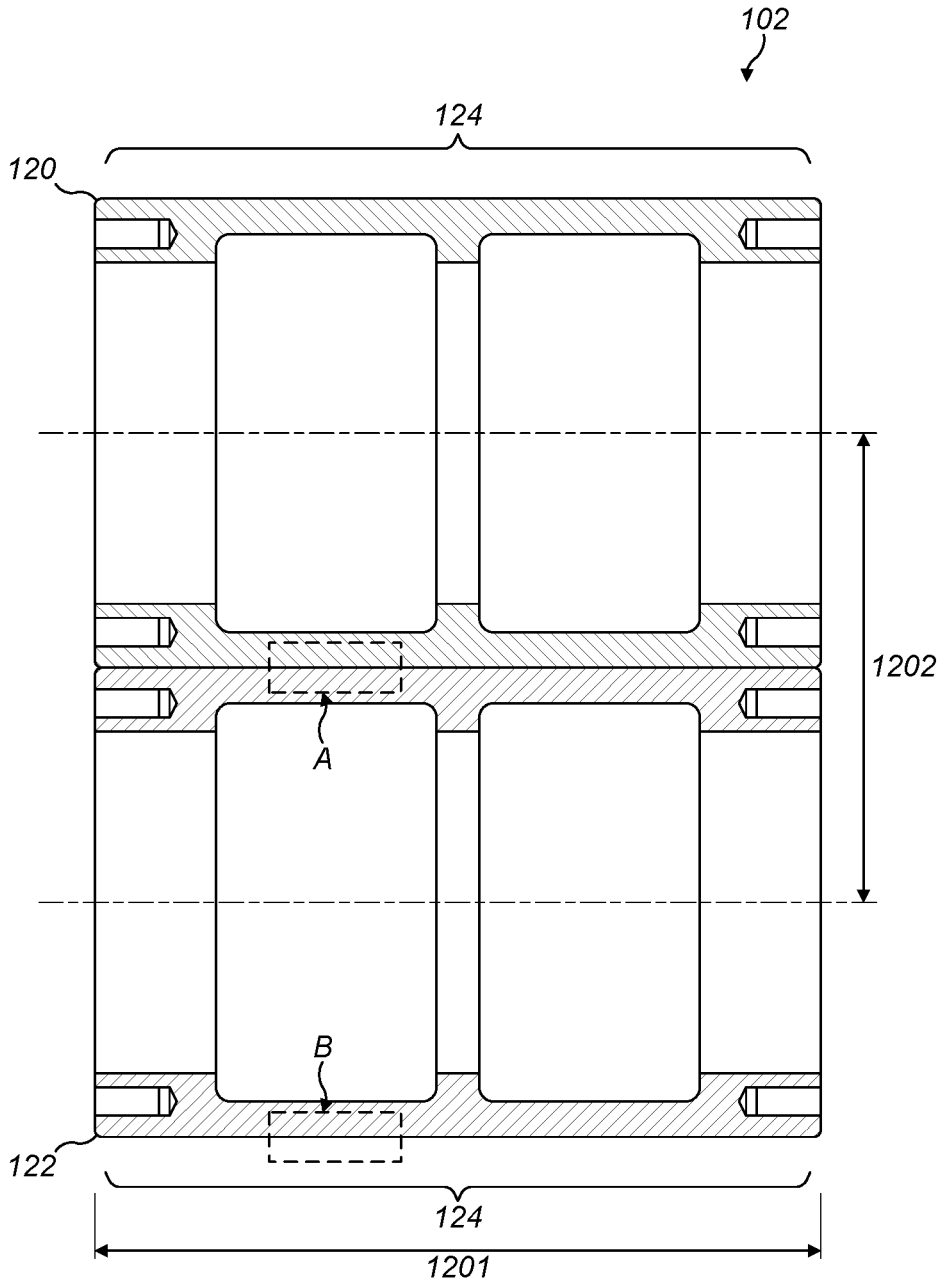
FIG. 2 is a cross-sectional view of first and second rollers of the apparatus of FIG. 1.

FIG. 2 shows a cross-sectional view of the set of crimping rollers 102. The set of crimping rollers 102 comprises a first roller 120 and a second roller 122, each of which is corrugated across its width 1201 in a corrugation zone 124. In this example, the corrugation zone 124 extends around the entire circumference of each roller and extends along substantially the entire width 1201 of each roller. Alternatively, one or both of the rollers could be corrugated across its width around only a portion of its circumference or along only a portion of its length, or around only a portion of its circumference and along only a portion of its length. The first and second rollers 120, 122 are arranged such that their axes are substantially parallel and such that their corrugations are substantially interleaved. The distance 1202 between the axes of the first and second rollers 120, 124 can be controlled to control the clearance between the corrugations of the first and second rollers 120, 122 and thus the amplitude of the crimp corrugations applied to a web passed between the set of rollers 102.

Figure 3:
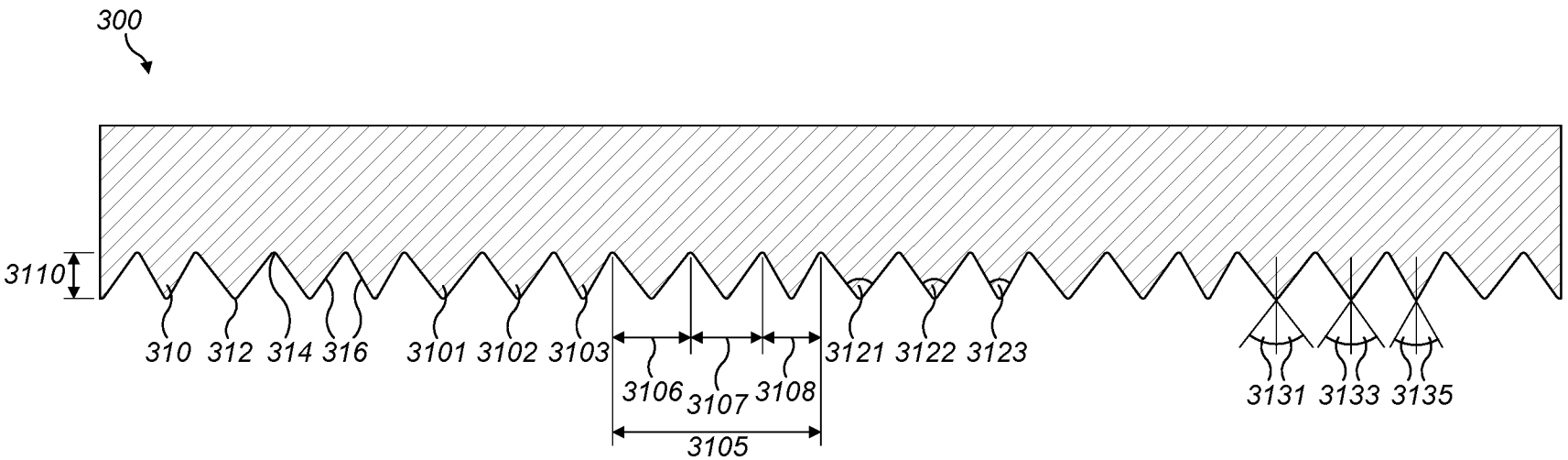
FIG. 3 is an enlarged view of detail A in FIG. 2 for a first embodiment of first roller.

FIG. 3 shows an enlarged view of a corrugated portion of a first embodiment of first roller 300. As shown, on the surface of the first roller 300 are a plurality of corrugations 310 formed from alternating peaks 312 and troughs 314 joined by corrugation flanks 316. The pitch values of the corrugations 310 vary across the width of the first roller 300. In this example, the corrugation zone of the first roller 300 is formed from a repeating pattern of different corrugations. The repeating pattern is three corrugations wide and consists of a first corrugation 3101 with a pitch value 3106, followed by a second corrugation 3102 with a pitch value 3107, followed by a third corrugation 3103 with a pitch value 3108. The repeating pattern thus has width 3105, which is equal to the sum of the first pitch value 3106, second pitch value 3107 and third pitch value 3108. Pitch values 3106, 3107 and 3108 are different. Thus, the pitch value of each corrugation in the repeating pattern differs from the pitch value of each directly adjacent corrugation and the pitch values of the corrugations vary across the width of the first roller 300. In alternative examples, the corrugation zone could be formed from an alternating pattern of different corrugations, such as a first corrugation alternating with second and third corrugations in a first, second, first, third pattern.

In this example, the three different corrugations 3101 to 3103 have substantially the same amplitude value 3110. To vary the pitch values, the corrugations angles of corrugations 3101 to 3103 are different. In particular, the corrugation angle 3121 of the first corrugation 3101 is greater than the corrugation angle 3122 of the second corrugation 3102, which in turn is greater than the corrugation angle 3123 of the third corrugation 3103. Thus, the corrugation angle of each corrugation differs from the corrugation angle of each directly adjacent corrugation.

The corrugation angle of a given corrugation is defined by the angle between its corrugation flanks. The corrugation flanks may be disposed at the same angle from the radial direction of the roller, or at a different angle. In this example of first roller, the angles formed by the corrugation flanks of each corrugation and the radial direction, or the "flank angles", are substantially the same, such that each corrugation is symmetrical about its peak in the radial direction. For each corrugation, both of the flank angles thus equate to approximately half of the corrugation angle. As the corrugation angles 3121, 3122 and 3123 are different, so to are the three flank angles 3131, 3133 and 3135 of the corrugations 3101, 3102 and 3103. Consequently, the troughs between directly adjacent corrugations are asymmetrical about the radial direction.

Figure 4:
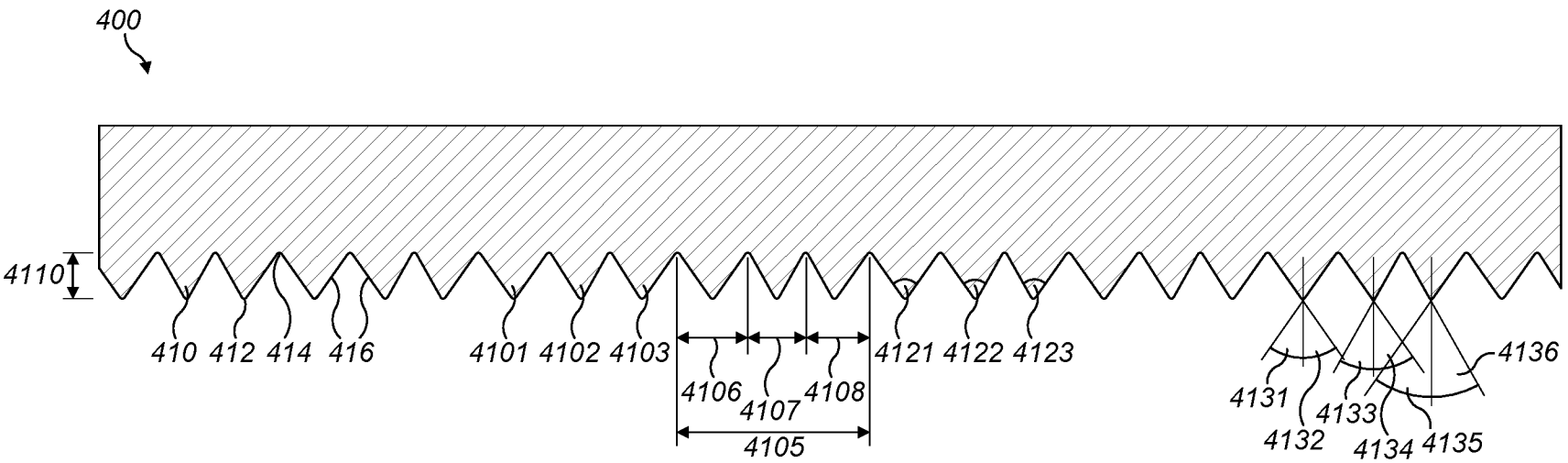
FIG. 4 is an enlarged view of detail B in FIG. 2 for a first embodiment of second roller.

FIG. 4 shows an enlarged view of a corrugated portion of a first embodiment of second roller 400. As with the first roller 300, on the surface of the second roller 400 are a plurality of corrugations 410 formed from alternating peaks 412 and troughs 414 joined by corrugation flanks 416. The pitch values of the corrugations 410 vary across the width of the second roller 400. As with the first roller 300, the corrugation zone of the second roller 400 is formed from a repeating pattern consisting of first corrugation 4101 with a pitch value 4106, followed by a second corrugation 4102 with a pitch value 4107, followed by a third corrugation 4103 with a pitch value 4108. The repeating pattern thus has width 4105, which is equal to the sum of the first pitch value 4106, the second pitch value 4107, and the third pitch value 4108. Pitch values 4106, 4107 and 4108 are different. Thus, the pitch value of each corrugation in the repeating pattern differs from the pitch value of each directly adjacent corrugation and the pitch values of the corrugations vary across the width of the second roller 400. In alternative examples, the corrugation zone could be formed from an alternating pattern of different corrugations, such as a first corrugation alternating with second and third corrugations in a first, second, first, third pattern.

The widths 3105, 4105 of the repeating patterns of both of the first and second rollers 300, 400 are substantially the same. This allows the corrugations of the first and second rollers 300, 400 to be aligned.

As with the first roller 300, the three different corrugations 4101 to 4103 of the second roller 400 have substantially the same amplitude value 4110. In this example, amplitude value 4110 is substantially the same as the amplitude value 3110 of the corrugations of the first roller 300, although this is not essential. To vary the pitch values, the corrugations angles of corrugations 4101 to 4103 are different. In particular, the corrugation angle 4121 of the first corrugation 4101 is greater than the corrugation angle 4122 of the second corrugation 4102, which in turn is greater than the corrugation angle 4123 of the third corrugation 4103. Thus, the corrugation angle of each corrugation differs from the corrugation angle of each directly adjacent corrugation.

The corrugation angle of a given corrugation is defined by the angle between its corrugation flanks. The corrugation flanks may be disposed at the same angle from the radial direction of the roller, or at a different angle. In this example of second roller, the two flank angles of each corrugation are different, such that each corrugation is asymmetrical about its peak in the radial direction. As shown in FIG. 4, the corrugation angle 4121 of the first corrugation 4101 is formed from different flank angles 4131 and 4132, the corrugation angle 4122 of the second corrugation 4102 is formed from different flank angles 4133 and 4134, and the corrugation angle 4123 of the third corrugation 4103 is formed from different flank angles 4135 and 4136. In this example, although the flank angles of a given corrugation are different, the flank angles of directly adjacent flanks of directly adjacent corrugations are the same. Consequently, the troughs between directly adjacent corrugations are symmetrical about the radial direction. This allows the troughs of the corrugations on the second roller 400 to interleave with the peaks of the corrugations on the first roller 300, which are also symmetrical about the radial direction. In addition, preferably the flank angles of the opposing corrugation flanks on the first and second rollers are substantially the same, such that the clearance between opposing corrugation flanks of the first and second rollers 300, 400 is substantially constant. This allows the formation of a crimped web having well defined crimp corrugations and a substantially constant nominal thickness.

In one particular embodiment, the various parameters have the following values:

| First roller: |
|---|
| 3106 = 1.3 mm |
| 3107 = 1.1 mm |
| 3108 = 0.9 mm |
| 3105 = 3.3 mm |
| 3110 = 0.6 mm |
| 3121 = 74 degrees |
| 3122 = 65 degrees |
| 3123 = 56 degrees |
| 3131 = 37 degrees |
| 3133 = 32.5 degrees |
| 3135 = 27.5 degrees |
| Second roller: |
| 4106 = 1.2 mm |
| 4107 = 1.0 mm |
| 4108 = 1.1 mm |
| 4105 = 3.3 mm |
| 4110 = 0.6 mm |
| 4121 = 69.5 degrees |
| 4122 = 60 degrees |
| 4123 = 64.5 degrees |
| 4132 = 37 degrees |
| 4131 = 32.5 degrees |
| 4134 = 32.5 degrees |
| 4133 = 27.5 degrees |
| 4136 = 27.5 degrees |
| 4135 = 37 degrees |

Figure 5:
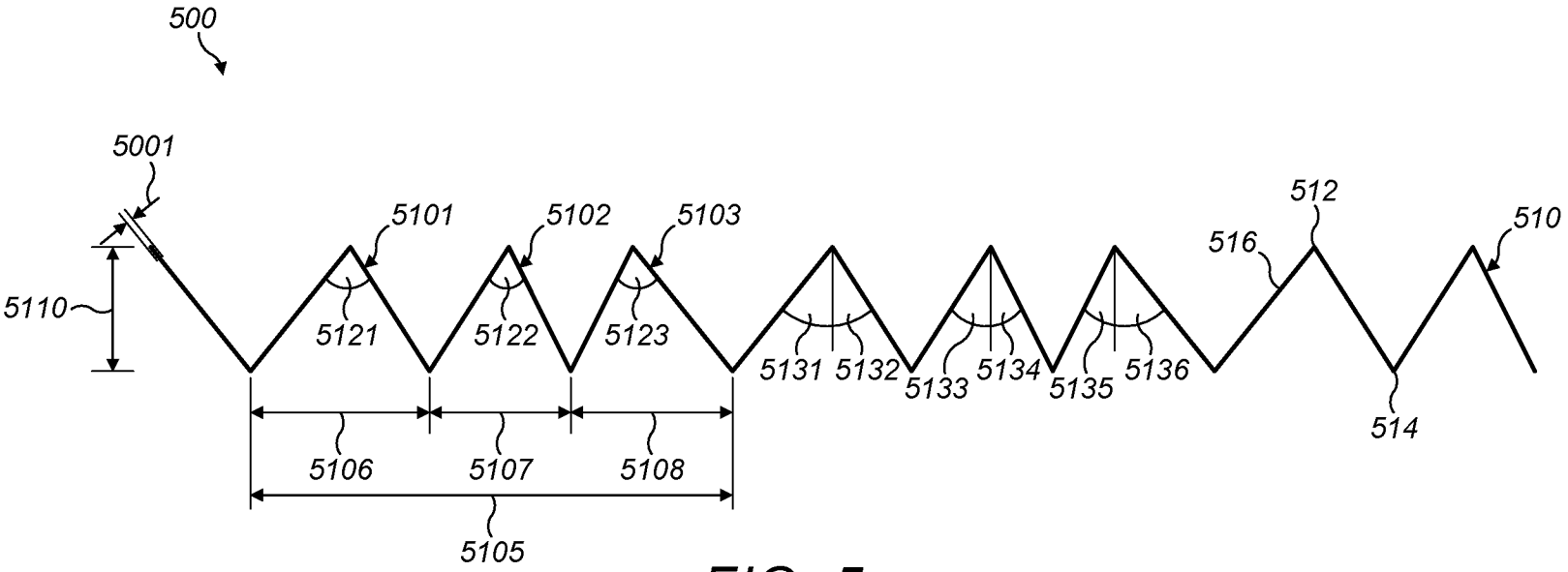
FIG. 5 is a cross-sectional view of a portion of a first embodiment of crimped sheet, formed using the rollers of FIGS. 3 and 4.

FIG. 5 shows a cross-sectional view of a portion of a first embodiment of crimped sheet 500, formed using the first and second rollers 300, 400 of FIGS. 3 and 4. The crimped sheet 500 has a nominal thickness 5001 and a plurality of substantially parallel crimp corrugations 510 extending along the length of the sheet 500 (in the direction perpendicular to the plane of FIG. 5). The crimp corrugations 510 are formed from alternating peaks 512 and troughs 514 joined by corrugation flanks 516. The shape and dimensions of the crimp corrugations 510 corresponds to the shape and dimensions of the first and second rollers 300, 400. In particular, the shape of the peaks 512 corresponds to the shape of the peaks of the corrugations of the second roller 400 and the shape of the troughs 514 corresponds to the shape of the peaks of the corrugations of the first roller 300.

Thus, as with the corrugations of the first and second rollers, the crimp corrugations 510 of the crimped sheet 500 are arranged in a repeating pattern consisting of a first crimp corrugation 5101 with a pitch value 5106, followed by a second crimp corrugation 5102 with a pitch value 5107, followed by a third crimp corrugation 5103 with a pitch value 5108. The repeating pattern thus has width 5105, which is equal to the sum of the first pitch value 5106, the second pitch value 5107, and the third pitch value 5108 and is the same as the pattern width of the corrugations on the first and second rollers 300, 400. Pitch values 5106, 5107 and 5108 are different from each other. Thus, the pitch value of each crimp corrugation differs from the pitch value of each directly adjacent crimp corrugation and the pitch values of the crimp corrugations vary across the width of the sheet 500.

As with the corrugations of the first and second rollers 300, 400, the three different crimp corrugations 5101 to 5103 of the sheet 500 have substantially the same amplitude value 5110. However, the corrugation angles 5121 to 5123 of the three different crimp corrugations 510 are different. As the shape of the peaks 512 and troughs 514 correspond respectively to the shape of the peaks of the second and first rollers 300, 400, each crimp corrugation 510 is asymmetrical about its peak, and the troughs between directly adjacent crimp corrugations are each symmetrical. In this example, the corrugation angles 5121 to 5123 and flank angles 5131, 5132, 5133, 5134, 5135 and 5136 of the crimp corrugations 5101 to 5103 are the same as those of the corrugations of the second roller 400.

As the pitch values of the crimp corrugations vary across the width of the sheet 500, the crimp corrugations of the crimped sheet are less likely to nest against each other when the crimped sheet 500 is gathered to form a rod for use in an aerosol-generating article. As a result, the axial channels formed by the crimp corrugations when gathered in the rod are more uniform in size and distribution across the area of the rod.

In one particular embodiment, the various parameters have the following values:

| Crimped sheet: |
|---|
| 5106 = 1.2 mm |
| 5107 = 1.0 mm |
| 5108 = 1.1 mm |
| 5109 = 3.3 mm |
| 5121 = 69.5 degrees |
| 5122 = 60 degrees |
| 5123 = 64.5 degrees |
| 5131 = 37 degrees |
| 5132 = 32.5 degrees |
| 5133 = 32.5 degrees |
| 5134 = 27.5 degrees |
| 5135 = 27.5 degrees |
| 5136 = 37 degrees |
| 5110 = 50 micrometres |

Figure 6:
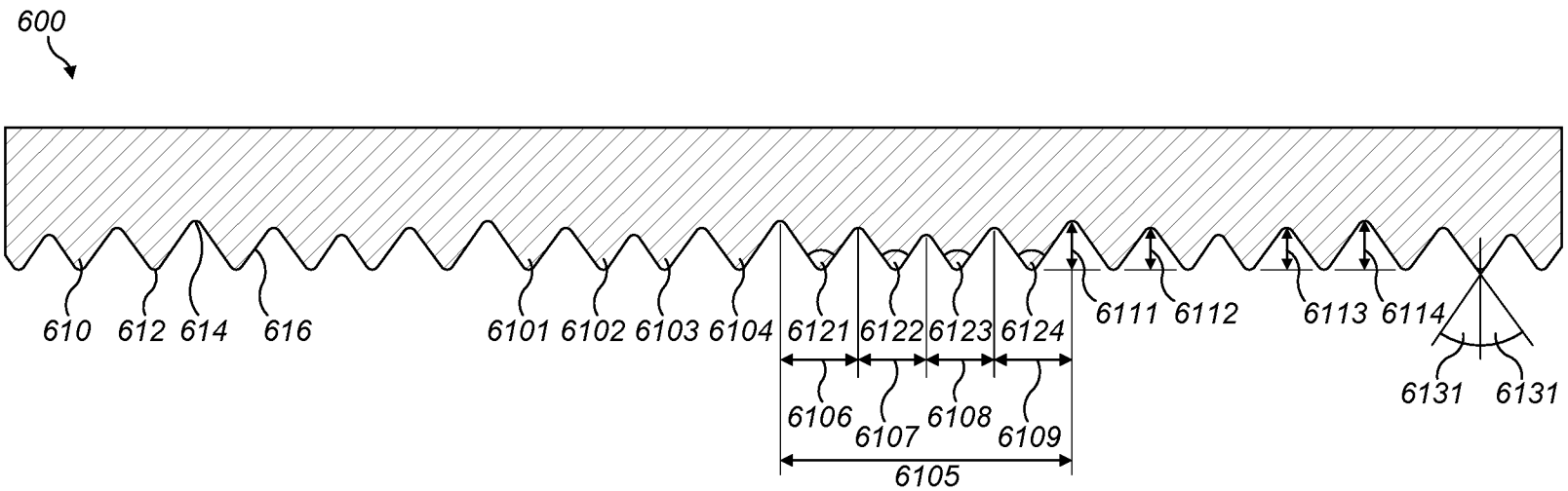
FIG. 6 is an enlarged view of detail A in FIG. 2 for a second embodiment of first roller.

FIG. 6 shows an enlarged view of a corrugated portion of a second embodiment of first roller 600. As shown, on the surface of the first roller 600 are a plurality of corrugations 610 formed from alternating peaks 612 and troughs 614 joined by corrugation flanks 616. The pitch values of the corrugations 610 vary across the width of the first roller 600. In this example, the corrugation zone of the first roller 600 is formed from a repeating pattern of different corrugations. The repeating pattern is four corrugations wide and consists of a first corrugation 6101 with a pitch value 6106, followed by a second corrugation 6102 with a pitch value 6107, followed by a third corrugation 6103 with a pitch value 6108, followed by a fourth corrugation 6104 with a pitch value 6109. The pattern thus has width 6105, which is equal to the sum of the first pitch value 6106, the second pitch value 6107, the third pitch value 6108, and the fourth pitch value 6109. In alternative examples, the corrugation zone could be formed from an alternating pattern of different corrugations, such as a first corrugation alternating with second, third and fourth corrugations in a first, second, first, third, first, fourth pattern.

In this example, the corrugation angles 6121 to 6124 of the four different corrugations 6101 to 6104 are substantially the same. The flank angles 6131 on either side of each corrugation peak are also substantially the same and equate to approximately half of the corrugation angle.

Although the corrugation angles of the four different corrugations 6101 to 6104 are substantially the same, the amplitude values are not. First, second, third, and fourth corrugations 6101 to 6104 have amplitude values 6111 to 6114, respectively. As mentioned previously, the amplitude value refers to the height of a corrugation from its peak to the deepest point of the deepest directly adjacent trough. For the first roller 600, the radial distance from the centre of the roller 600 to the peaks 612 of the corrugations 610 is substantially the same across the width of the roller. However, the radial distance from the centre of the roller to the troughs 614 of the corrugations 610, or the "depth" of the troughs 614, varies across the width of the roller 600. In particular, the depth of the troughs 614 varies such that the amplitude values 6111, 6114 and pitch values 6106, 6109 of the first and fourth corrugations 6101 and 6104 are substantially the same, as are the amplitude values 6112, 6113 and pitch values 6107, 6108 of the second and third corrugations 6102 and 6103. The first and fourth amplitude values 6111, 6114 and pitch values 6106, 6109 are greater than the second and third amplitude values 6112, 6113 and pitch values 6107, 6108. Thus, the amplitude value of each corrugation differs from the amplitude value of at least one directly adjacent corrugation. In this manner, the amplitude values and, thus, the pitch values of the corrugations vary across the width of the first roller 600.

Figure 7:
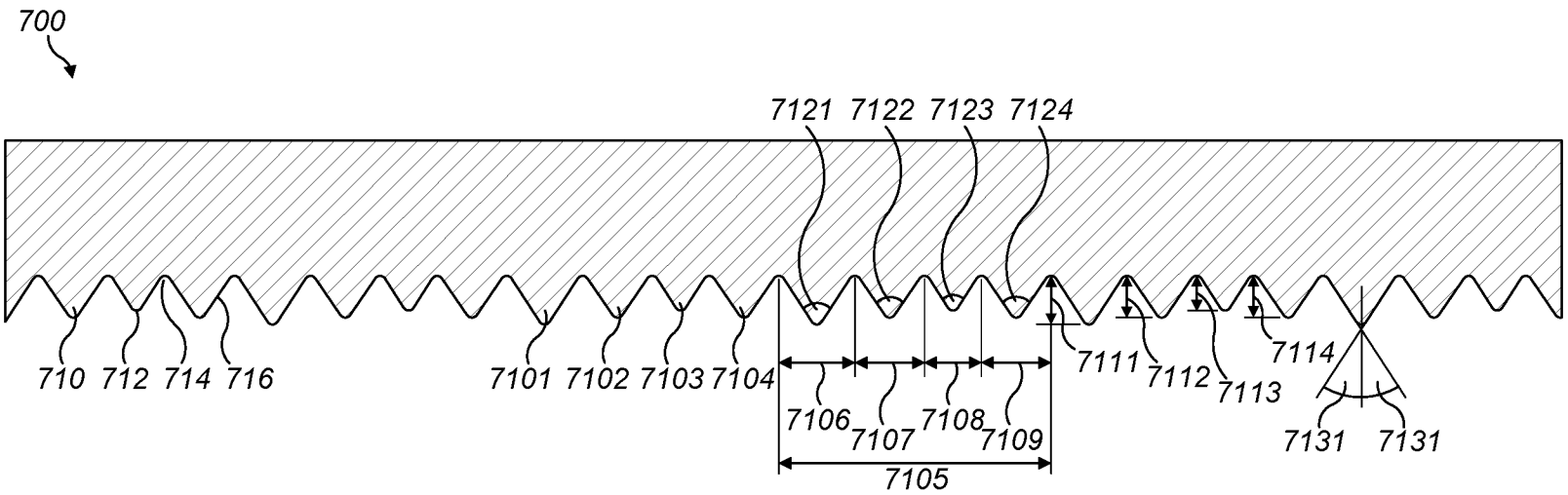
FIG. 7 is an enlarged view of detail B in FIG. 2 for a second embodiment of second roller.

FIG. 7 shows an enlarged view of a corrugated portion of a second embodiment of second roller 700. As with the first roller 600, on the surface of the second roller 700 are a plurality of corrugations 710 formed from alternating peaks 712 and troughs 714 joined by corrugation flanks 716. The pitch values of the corrugations 710 vary across the width of the second roller 700. In this example, the corrugation zone of the second roller 700 is formed from a repeating pattern of different corrugations. The repeating pattern is four corrugations wide and consists of a first corrugation 7101 with a first pitch value 7106, followed by a second corrugation 7102 with a second pitch value 7107, followed by a third corrugation 7103 with a third pitch value 7108, followed by a fourth corrugation 7104 with a fourth pitch angle 7109. The repeating pattern thus has a width P, which is equal to the sum of the first pitch value 7106, the second pitch value 7107, the third pitch value 7108, and the fourth pitch value 7109. In alternative examples, the corrugation zone could be formed from an alternating pattern of different corrugations, such as a first corrugation alternating with second, third and fourth corrugations in a first, second, first, third, first, fourth pattern.

In this example, the corrugation angles 7121 to 7124 of the four different corrugations 7101 to 7104 are substantially the same. The flank angles 7131 on either side of each corrugation peak are also substantially the same and equate to approximately half of the corrugation angle.

Although the corrugation angles of the four different corrugations 7101 to 7104 are substantially the same, the amplitude values are not. First, second, third, and fourth corrugations 7101 to 7104 have amplitude values 7111 to 7114, respectively. As mentioned previously, the amplitude value refers to the height of a corrugation from its peak to the deepest point of the deepest directly adjacent trough. Unlike the first roller 600, the radial distance from the centre of the second roller 700 to the troughs 714 of the corrugations 710, or the "depth" of the troughs 714, is substantially the same across the width of the roller, whereas the radial distance from the centre of the roller to the peaks 712 of the corrugations 710 varies across the width of the roller.

In particular, the radial distance from the centre of the roller to the peaks 712 of the corrugations 710 is such that the amplitude value 7111 of the first corrugation 7101 is greater than the amplitude value 7112 of the second corrugation 7102, which is greater than the amplitude value 7113 of the third corrugation 7103. The amplitude value 7114 of the fourth corrugation 7104 is substantially the same as the amplitude value 7112 of the second corrugation 7102. Consequently, the pitch value 7106 of the first corrugation 7101 is greater than the pitch value 7107 of the second corrugation 7102, which is the same as the pitch value 7109 of the fourth corrugation 7104, both of which are greater than the pitch value 7108 of the third corrugation 7103. Thus, the amplitude value of each corrugation differs from the amplitude value of at least one directly adjacent corrugation. In this manner, the amplitude values and, thus, the pitch values of the corrugations vary across the width of the second roller 700.

Preferably, the widths of the repeating patterns of both of the first and second rollers 600, 700 are substantially the same. This allows the corrugations of the first and second rollers 600, 700 to be aligned. In addition, preferably the corrugation angles and flank angles of the corrugations of both rollers are also the same, such that the corrugations interleave and the clearance between opposing corrugation flanks of the first and second rollers 600, 700 is substantially constant. This allows the formation of a crimped web having well defined crimp corrugations and a substantially constant nominal thickness.

In one particular embodiment, the various parameters have the following values:

| First roller: |
|---|
| 6106 = 1.2 mm |
| 6107 = 1.0 mm |
| 6108 = 1.0 mm |
| 6109 = 1.2 mm |
| 6105 = 4.4 mm |
| 6111 = 0.83 mm |
| 6112 = 0.55 mm |
| 6113 = 0.55 mm |
| 6114 = 0.73 mm |
| 6121 = 60 degrees |
| 6122 = 60 degrees |
| 6123 = 60 degrees |
| 6124 = 60 degrees |
| 6131 = 30 degrees |
| Second roller: |
| 7106 = 1.3 mm |
| 7107 = 1.1 mm |
| 7108 = 0.9 mm |
| 7109 = 1.1 mm |
| 7105 = 4.4 mm |
| 7111 = 0.83 mm |
| 7112 = 0.73 mm |
| 7113 = 0.55 mm |
| 7114 = 0.73 mm |
| 7121 = 60 degrees |
| 7122 = 60 degrees |
| 7123 = 60 degrees |
| 7124 = 60 degrees |
| 7131 = 30 degrees |

Figure 8:
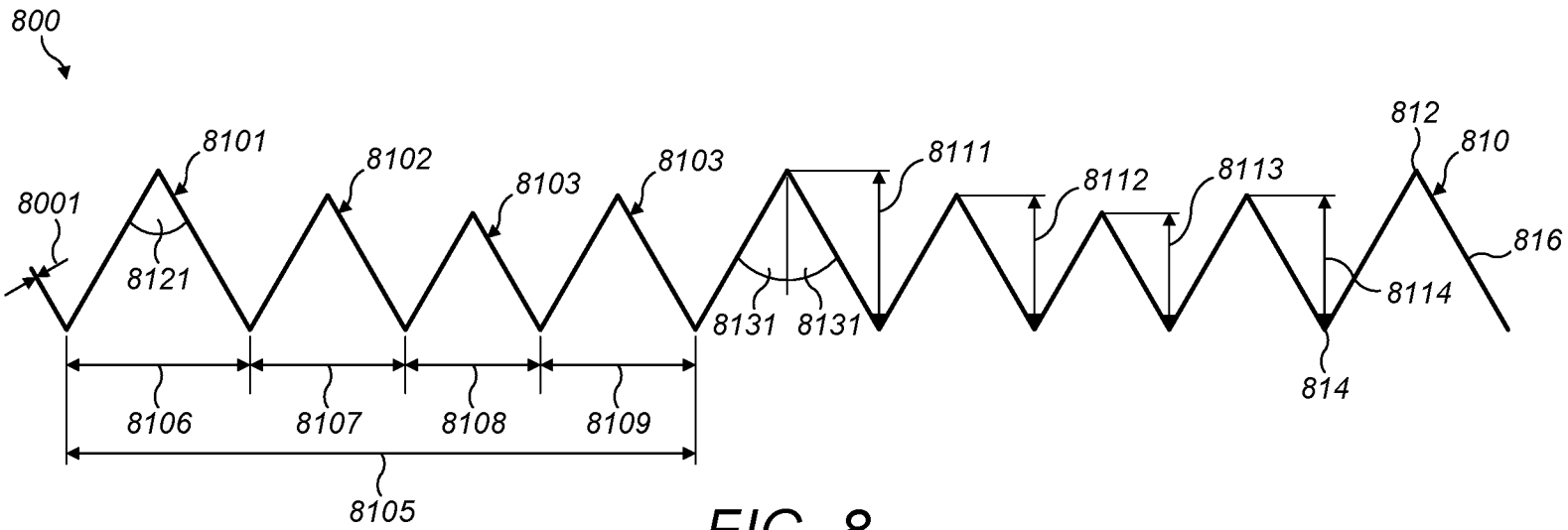
FIG. 8 is a cross-sectional view of a portion of a second embodiment of crimped sheet, formed using the rollers of FIGS. 6 and 7.

FIG. 8 shows a cross-sectional view of a portion of a second embodiment of crimped sheet 800, formed using the first and second rollers 600, 700 of FIGS. 6 and 7. The crimped sheet 800 has a nominal thickness 8001 and a plurality of substantially parallel crimp corrugations 810 extending along the length of the sheet 800 (in the direction perpendicular to the plane of FIG. 8). The crimp corrugations 810 are formed from alternating peaks 812 and troughs 814 joined by corrugation flanks 816. The shape and dimensions of the crimp corrugations 810 corresponds to the shape and dimensions of the first and second rollers 600, 700. In particular, the shape of the peaks 812 corresponds to that of the peaks of the corrugations of the second roller 700 and the shape of the troughs 814 corresponds to the shape of the peaks of the corrugations of the first roller 600.

Thus, as with the corrugations of the first and second rollers, the crimp corrugations 810 of the crimped sheet 800 are arranged in a repeating pattern of four different crimp corrugations. The repeating pattern is four crimp corrugations wide and consists of a first crimp corrugation 8101 with a pitch value 8106, followed by a second crimp corrugation 8102 with a pitch value 8107, followed by a third crimp corrugation 8103 with a pitch value 8108, followed by a fourth crimp corrugation 8104 with a pitch value 8109. The pattern thus has width 8105, which is equal to the sum of the first pitch value 8106, the second pitch value 8107, the third pitch value 8108, and the fourth pitch value 8109 and is equal to the pattern width of the corrugations on the first and second rollers 600, 700. In alternative examples, the corrugation zone could be formed from an alternating pattern of different corrugations, such as a first corrugation alternating with second, third and fourth corrugations in a first, second, first, third, first, fourth pattern.

In this example, the four different crimp corrugations 8101 to 8104 have substantially the same corrugation angle 8121 and flank angles 8131 as each other. The flank angles 8131 on either side of each crimp corrugation peak are also substantially the same as each other and equate to approximately half of the corrugation angle 8121.

Although the corrugation angles of the four different crimp corrugations 8101 to 8104 are substantially the same, the amplitude values are not. First, second, third, and fourth crimp corrugations 8101 to 8104 have amplitude values 8111 to 8114, respectively. The amplitude value 8111 of the first crimp corrugation 8101 is greater than the amplitude value 8112 of the second crimp corrugation 8102, which is greater than the amplitude value 8113 of the third crimp corrugation 8103. The amplitude value 8114 of the fourth crimp corrugation 8104 is substantially the same as the amplitude value 8112 of the second crimp corrugation 8102. Consequently, the pitch value 8106 of the first crimp corrugation 8101 is greater than the pitch value 8107 of the second crimp corrugation 8102, which is the same as the pitch value 8109 of the fourth crimp corrugation 8104, both of which are greater than the pitch value 8108 of the third crimp corrugation 8103. Thus, the amplitude value of each crimp corrugation differs from the amplitude value of both directly adjacent crimp corrugations. In this manner, the amplitude values and, thus, the pitch values of the crimp corrugations vary across the width of the sheet. Consequently, the crimp corrugations of the crimped sheet 800 are less likely to nest against each other when it is gathered to form a rod for use in an aerosol-generating article. As a result, the axial channels formed by the crimp corrugations in the rod are more uniform in size and distribution across the area of the rod.

In one particular embodiment, the various parameters have the following values:

| Crimped sheet: |
|---|
| 8106 = 1.3 mm |
| 8107 = 1.1 mm |
| 8108 = 0.9 mm |
| 8109 = 1.1 mm |
| 8105 = 4.4 mm |

-continued

| |
|---|
| 8111 = 0.83 mm |
| 8112 = 0.73 mm |
| 8113 = 0.55 mm |
| 8114 = 0.73 mm |
| 8121 = 60 degrees |
| 8131 = 30 degrees |
| 8001 = 50 micrometres |

Figure 9A:
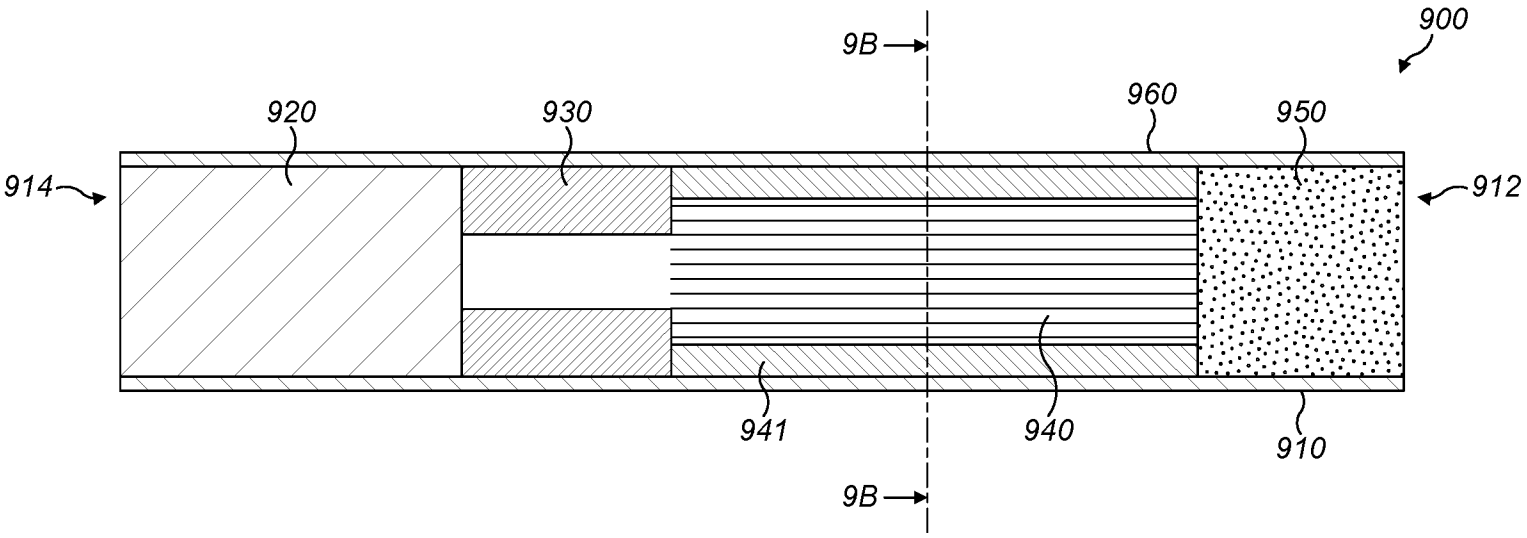
FIG. 9A is a schematic cross-sectional side view of an aerosol-generating article according to the present invention.
Figure 9B:
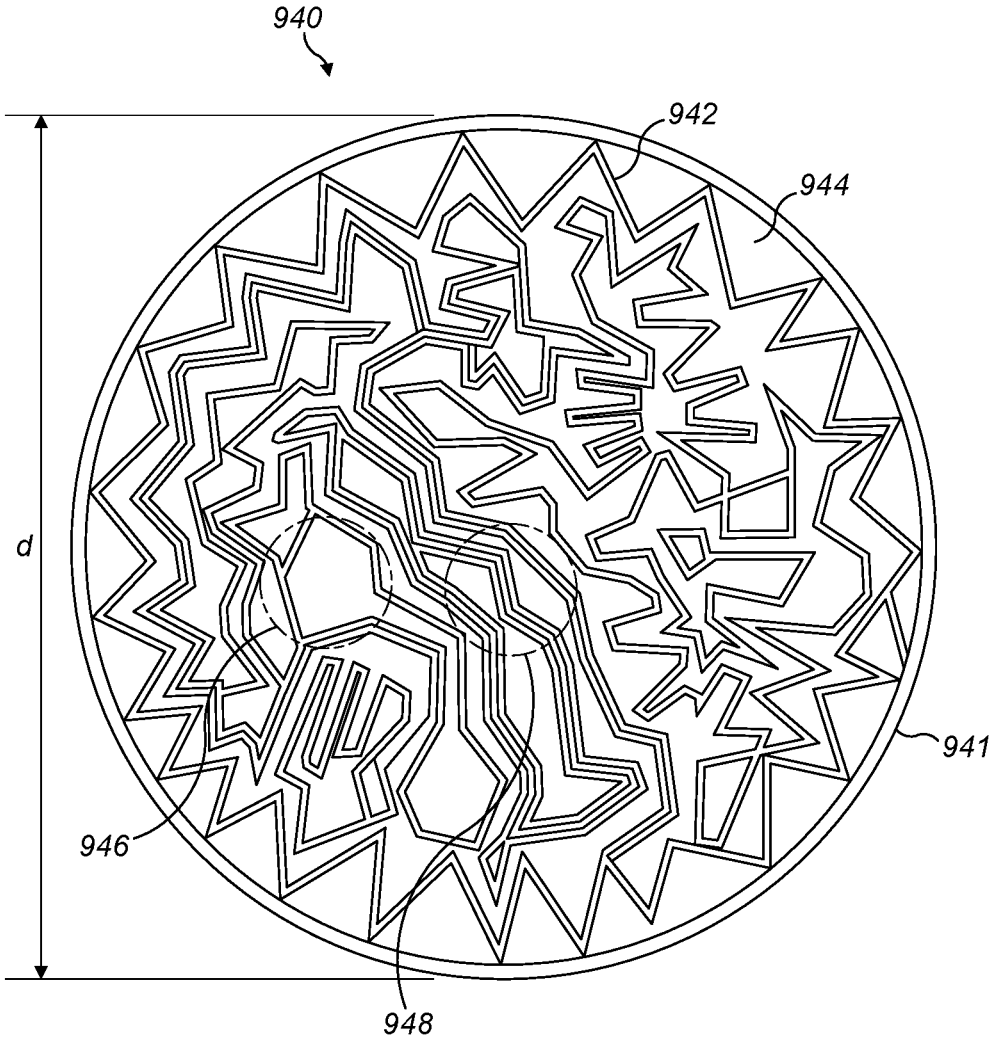
FIG. 9B is a schematic cross-sectional view of the aerosol-generating article of FIG. 9A taken through the line 9B-9B in FIG. 9A.

FIGS. 9A and 9B illustrate an aerosol-generating article 900 according to an embodiment. The aerosol-generating article 900 comprises four elements, an aerosol-forming substrate 920, a hollow cellulose acetate tube 930, an aerosol-cooling element 940, and a mouthpiece filter 950. These four elements are arranged sequentially and in coaxial alignment and are assembled by a cigarette paper 960 to form a rod 910. The rod 910 has a mouth-end 912, and a distal end 914 located at the opposite end of the rod 910 to the mouth end 914. Elements located between the mouth-end 912 and the distal end 914 can be described as being upstream of the mouth-end 912 or, alternatively, downstream of the distal end 914.

When assembled, the rod 910 is about 45 millimetres in length and has a diameter of about 7 millimetres.

The aerosol-forming substrate 920 is located upstream of the hollow tube 930 and extends to the distal end 914 of the rod 910. In one embodiment, the aerosol-forming substrate 920 comprises a bundle of crimped cast-leaf tobacco wrapped in a filter paper (not shown) to form a plug. The cast-leaf tobacco includes additives, including glycerine as an aerosol-forming additive. In another embodiment, the aerosol-forming substrate comprises a gathered, crimped sheet of homogenised tobacco material.

The hollow acetate tube 930 is located immediately downstream of the aerosol-forming substrate 920 and is formed from cellulose acetate. One function of the tube 930 is to locate the aerosol-forming substrate 920 towards the distal end 914 of the rod 910 so that it can be contacted with a heating element. The tube 930 acts to prevent the aerosol-forming substrate 920 from being forced along the rod 910 towards the aerosol-cooling element 940 when a heating element is inserted into the aerosol-forming substrate 920. The tube 930 also acts as a spacer element to space the aerosol-cooling element 940 from the aerosol-forming substrate 920.

The aerosol-cooling element 940 has a length of about 18 mm and a diameter of about 7 mm. In this example, the aerosol-cooling element 940 is formed from a gathered, crimped sheet 942 having a plurality of substantially parallel crimp corrugations extending in a longitudinal direction of the sheet, wherein the pitch values of the crimp corrugations vary across the width of the sheet and wherein the crimp corrugations define a plurality of axial channels 944 that extend along the length of the aerosol-cooling element 940. In one embodiment, the aerosol-cooling element 940 is formed from a sheet of polylactic acid having a nominal thickness of 50 micrometres.

Porosity is defined herein as a measure of unfilled space in a rod including an aerosol-cooling element consistent with the one discussed herein. For example, if a diameter of the rod 910 was 50 percent unfilled by the element 940, the porosity would be 50 percent. Likewise, a rod would have a porosity of 100 percent if the inner diameter was completely unfilled and a porosity of 0 percent if completely filled. The porosity may be calculated using known methods. When the aerosol-cooling element 940 is formed from a sheet of material having a thickness (t) and a width (w) the cross-sectional area presented by an edge of the sheet is given by the width multiplied by the thickness. In a specific embodiment of a sheet material having a thickness of 50 micrometers and width of 230 millimetres, the cross-sectional area is approximately 1.15×10^−5 metres squared (this may be denoted the first area). Assuming a diameter of the rod that will eventually enclose the material is 7 mm, the area of unfilled space may be calculated as approximately 3.85×10^−5 metres squared (this may be denoted the second area).

The crimped sheet 942 comprising the aerosol-cooling element 940 is then gathered and confined within the inner diameter of the rod. The ratio of the first and second area based on the above examples is approximately 0.30. This ratio is multiplied by 100 and the quotient is subtracted from 100 percent to arrive at the porosity, which is approximately 70 percent for the specific figures given here. Clearly, the thickness and width of a sheet material may be varied. Likewise, the diameter of the rod may be varied.

As shown in FIG. 9B, the crimp corrugations of the crimped and gathered sheet 942 define a plurality of axial channels 944 in the aerosol-cooling element 940. Depending on the degree to which the crimp corrugations of adjacent portions of gathered sheet cluster together, the size and distribution of the axial channels 944 can vary across the area of aerosol-cooling element 940, leading to areas of high local porosity 946 and areas of low local porosity 948, as shown in FIG. 9B. Due to the fact that the pitch values of the crimped sheet 942 vary across the width of the sheet, the crimp corrugations of adjacent portions of sheet are less likely to align and nest together and the distribution of the axial channels 944 is more uniform.

It will now be obvious to one of ordinary skill in the art that with a known thickness and width of a material, in addition to the inner diameter of the rod, the porosity can be calculated in the above manner. Accordingly, where a sheet of material has a known thickness and length, and is crimped and gathered along the length, the space filled by the material can be determined. The unfilled space may be calculated, for example, by taking the inner diameter of the rod. The porosity or unfilled space within the rod can then be calculated as a percentage of the total area of space within the rod from these calculations.

The crimped and gathered sheet of polylactic acid is wrapped within a filter paper 941 to form the aerosol-cooling element 940.

The mouthpiece filter 950 is a conventional mouthpiece filter formed from cellulose acetate, and having a length of about 4.5 millimetres.

The four elements identified above are assembled by being tightly wrapped within a paper 960. The paper 960 in this specific embodiment is a conventional cigarette paper having standard properties. The interference between the paper 960 and each of the elements locates the elements and defines the rod 910 of the aerosol-generating article 900.

Although the specific embodiment described above and illustrated in FIGS. 9A and 9B has four elements assembled in a cigarette paper, it is clear than an aerosol-generating article may have additional elements or fewer elements.

An aerosol-generating article as illustrated in FIGS. 9A and 9B is designed to engage with an aerosol-generating device (not shown) in order to be consumed. Such an aerosol-generating device includes means for heating the aerosol-forming substrate 920 to a sufficient temperature to form an aerosol. Typically, the aerosol-generating device may comprise a heating element that surrounds the aerosol-generating article adjacent to the aerosol-forming substrate 920, or a heating element that is inserted into the aerosol-forming substrate 920.

Once engaged with an aerosol-generating device, the aerosol-forming substrate 920 may be heated to a temperature of about 375 degrees Celsius. At this temperature, volatile compounds are evolved from the aerosol-forming substrate 920. These compounds condense to form an aerosol, which passes through the rod 910.

The aerosol is drawn through the aerosol-cooling element 940. As the aerosol passes thorough the aerosol-cooling element 940, the temperature of the aerosol is reduced due to transfer of thermal energy to the aerosol-cooling element 940. Furthermore, water droplets condense out of the aerosol and adsorb to internal surfaces of the axial channels defined through the aerosol-cooling element 940.

When the aerosol enters the aerosol-cooling element 940, its temperature is about 60 degrees Celsius. Due to cooling within the aerosol-cooling element 940, the temperature of the aerosol as it exits the aerosol cooling element 940 is about 40 degrees Celsius. Furthermore, the water content of the aerosol is reduced. Depending on the type of material forming the aerosol-cooling element 940, the water content of the aerosol may be reduced from anywhere between 0 and 90 percent. For example, when element 940 is comprised of polylatic acid, the water content is not considerably reduced, that is, the reduction will be approximately 0 percent. In contrast, when the starch based material, is used to form element 940, the reduction may be approximately 40 percent. It will now be apparent to one of ordinary skill in the art that through selection of the material comprising element 940, the water content in the aerosol may be adapted.

The invention claimed is:

1. An apparatus for manufacturing a crimped web for an aerosol-generating article, the apparatus comprising:

a set of crimping rollers comprising a first roller and a second roller, each of which is corrugated across at least a portion of a width thereof, wherein the first and the second rollers are arranged such that corrugations of the first roller substantially interleave with corrugations of the second roller, wherein pitch values of the corrugations of one or both of the first and the second rollers vary across the width of the rollers, wherein the pitch values of substantially all of the corrugations of the first and the second rollers vary from about 0.5 mm to about 1.7 mm, and wherein the apparatus includes at least one of:

each of at least some of the corrugations of the first and second rollers has an amplitude value that differs from an amplitude value of at least one directly adjacent corrugation of said corrugations, the amplitude values of the corrugations of the first and second rollers varying from about 0.1 mm to about 1.5 mm, and each of at least some of the corrugations of the first and second rollers has a corrugation angle that differs from a corrugation angle of at least one directly adjacent corrugation of said corrugations, the corrugation angles of the corrugations of the first and second rollers varying from about 30 degrees to about 90 degrees.

2. A crimped sheet for at least one of an aerosol-cooling element and an aerosol-forming substrate for an aerosol-generating article, the crimped sheet comprising:

a plurality of substantially parallel crimp corrugations extending in a longitudinal direction of the crimped sheet, wherein pitch values of the substantially parallel crimp corrugations vary across a width of the crimped sheet, wherein the pitch values of substantially all of the crimp corrugations vary from about 0.5 mm to about 1.7 mm, and wherein the crimped sheet includes at least one of:

each of at least some of the crimp corrugations has an amplitude value that differs from an amplitude value of at least one directly adjacent crimp corrugation of said crimp corrugations, the amplitude values of the crimp corrugations varying from about 0.1 mm to about 1.5 mm, and each of at least some of the crimp corrugations has a corrugation angle that differs from a corrugation angle of at least one directly adjacent crimp corrugation of said crimp corrugations, the corrugation angles of the crimp corrugations varying from about 30 degrees to about 90 degrees.

3. The crimped sheet according to claim 2, further comprising a sheet material selected from a group including a metallic foil, a polymeric sheet, paper, a homogenised tobacco material, and a combination thereof.

4. An aerosol-cooling element for an aerosol-generating article, the aerosol-cooling element comprising:

a rod formed from a gathered crimped sheet according to claim 2, wherein the plurality of substantially parallel crimp corrugations of the gathered crimped sheet define a plurality of axial channels in the rod.

5. An aerosol-forming substrate for an aerosol-generating article, the aerosol-forming substrate comprising:

a rod formed from a gathered crimped sheet according to claim 2, wherein the plurality of substantially parallel crimp corrugations define a plurality of axial channels in the rod.

6. An aerosol-generating article comprising an aerosol-cooling element according to claim 4.

7. An aerosol-generating article comprising an aerosol-forming substrate according to claim 5.

8. A method of manufacturing an aerosol-generating article component, the method comprising:

manufacturing a crimped web;

gathering the crimped web to form a continuous rod; and cutting the continuous rod into a plurality of rod-shaped components, each rod-shaped component of said plurality having a gathered crimped sheet formed from a cut portion of the crimped web, crimp corrugations of the gathered crimped sheet defining a plurality of axial channels in said each rod-shaped component, and said each rod-shaped component having a porosity in an axial direction of greater than 50 percent, wherein the manufacturing the crimped web comprises the steps of:

feeding a substantially continuous web to a set of crimping rollers, the set of crimping rollers comprising a first roller and a second roller, each of which is corrugated across at least a portion of a width thereof, the first and the second rollers being arranged such that corrugations of the first roller substantially interleave with corrugations of the second roller; and crimping the substantially continuous web to form the crimped web by feeding the substantially continuous web between the first and the second rollers in a longitudinal direction of the web such that the corrugations of the first and the second rollers apply a plurality of longitudinally extending and substantially parallel crimp corrugations to the substantially continuous web, wherein pitch values of the corrugations of one or both of the first and the second rollers vary across the width of the rollers such that pitch values of the crimp corrugations vary across a width of the crimped web, wherein the pitch values of substantially all of the corrugations of the first and the second rollers vary from about 0.5 mm to about 1.7 mm, and wherein the crimping rollers include at least one of:

each of at least some of the corrugations of the first and second rollers has an amplitude value that differs from an amplitude value of at least one directly adjacent corrugation of said corrugations, the amplitude values of the corrugations of the first and second rollers varying from about 0.1 mm to about 1.5 mm, and each of at least some of the corrugations of the first and second rollers has a corrugation angle that differs from a corrugation angle of at least one directly adjacent corrugation of said corrugations, the corrugation angles of the corrugations of the first and second rollers varying from about 30 degrees to about 90 degrees.

* * * * *